United States Patent [19]

Kunitake et al.

[11] Patent Number: 5,002,004

[45] Date of Patent: Mar. 26, 1991

[54] PLANING BOAT

[75] Inventors: Yoshikuni Kunitake, Nagareyama; Takeo Nojiri, Kamakura; Kazuaki Kurihara, Tokyo, all of Japan

[73] Assignee: Mitsui Engineering & Shipbuilding Co., Ltd., Tokyo, Japan

[21] Appl. No.: 381,715

[22] PCT Filed: Oct. 31, 1988

[86] PCT No.: PCT/JP88/01110

§ 371 Date: Jul. 10, 1989

§ 102(e) Date: Jul. 10, 1989

[87] PCT Pub. No.: WO89/04273

PCT Pub. Date: May 18, 1989

[30] Foreign Application Priority Data

Nov. 11, 1987 [JP] Japan ..... 62-171373[U]

[51] Int. Cl.[5] ..... B63B 1/24

[52] U.S. Cl. ..... 114/274; 114/61

[58] Field of Search ..... 114/56, 61, 271, 274, 114/288–291; 440/68, 69

[56] References Cited

U.S. PATENT DOCUMENTS

| | | | |
|---|---|---|---|
| 2,269,801 | 1/1942 | Willrich, Jr. | 114/291 X |
| 2,397,683 | 4/1946 | Nelson | 114/291 X |
| 3,469,549 | 9/1969 | Rae | 114/66.5 |
| 3,477,400 | 11/1969 | Walker | 114/291 X |
| 3,650,239 | 3/1972 | Gast | 440/69 |
| 3,763,810 | 10/1973 | Payne | 114/291 X |
| 4,609,360 | 9/1986 | Whitehead | 440/69 |
| 4,665,853 | 5/1987 | Gerdsen et al. | 114/274 X |
| 4,689,026 | 8/1987 | Small | 440/69 |
| 4,748,929 | 6/1988 | Payne | 114/288 X |
| 4,915,668 | 4/1990 | Hardy | 440/69 |

FOREIGN PATENT DOCUMENTS

| | | |
|---|---|---|
| 53-60094 | 5/1978 | Japan . |
| 54-95491 | 7/1979 | Japan . |
| 88/08387 | 11/1988 | PCT Int'l Appl. . |

*Primary Examiner*—Ed Swinehart

*Attorney, Agent, or Firm*—Armstrong, Nikaido, Marmelstein, Kubovcik & Murray

[57] ABSTRACT

A hull (5) of a planing boat (1) consists of front and rear hull portions (5*a*, 5*b*). A bottom part (2*a*) of the front hull portion (5*a*) forms one front planing portion (21*a*), and a recess (7) is provided so as to extend along the center line of the rear hull portion (5*b*), two bottom parts (2*b*') either of which is positioned on the left or right side of this recess (7) forming two rear planing portions (21*b*). When the speed of the planing boat (1) is low, it runs with the front and rear planing portions (21*a*, 21*b*) completely submerged, and, when the speed of the planing boat (1) is high, it floats and plans on the water surface with the hull (5) supported on three portions, one front planing portion (21*a*) and two rear planing portions (21*b*).

1 Claim, 7 Drawing Sheets

PLANING BOAT

TECHNICAL FIELD

This invention relates to a planing boat which skims over the surface of water at high speeds.

BACKGROUND ART

Generally, in a single-hull type planing boat, as the speed of the boat increases, the center of lift shifts too much toward the stern with respect to the center of gravity, causing a porpoising and a large pitching, making the traveling unstable.

On the other hand, in a 3-point-support type planing boat whose forepart is supported by two planing portions and its afterpart is supported by one planing portion, the center of gravity is located between three front and rear lifts even when the speed of the boat increases. This prevents a porpoising and a large pitching, realizing a stable planing on the surface of water.

In the latter type, however, since the number of planing portions in the forepart of the hull is greater than that in the afterpart, the ability of making a turn is degraded. Another drawback is that since only one planing portion is provided in the afterpart, it is difficult to mount two or more engines. Furthermore, there is a limitation in the arrangement of the cabin space.

DISCLOSURE OF THE INVENTION

This invention has been accomplished with a view to overcoming the abovementioned drawbacks. The object of the invention is to provide a planing boat that can realize a stable high-speed skimming over the surface of water and which has an improved performance of advancing straight ahead and making a turn and an improved sea kindliness, compared with the conventional 3-point-support type planing boat.

Another object of the invention is to provide a planing boat which can mount a plurality of engines and has reduced restriction in the arrangement of cabin space.

The planing boat of this invention is characterized in comprising:

- a front hull portion ranging from the bow to the mid portion of the hull;
- a rear hull portion ranging from the mid portion of the hull to the stern, the rear hull portion being formed with a recess, the recess opening downwardly from the bottom part of the rear hull portion, the recess also opening rearwardly from the stern, the rear hull portion having a plurality of bottom parts on the left and right side of the recess;
- one front planing portion formed by the bottom part of the front hull portion; and
- a plurality of rear planing portions formed by the plurality of bottom parts of the rear hull portion.

The planing boat of this invention with the above construction has the following advantages.

(a) A stable high-speed skimming is achieved. The skeg effect by a plurality of rear planing portions in the rear hull portion improves the course keeping performance over the conventional 3-point-support type glide boat.

(b) The combination of the smooth turning capability of the bow and the keel effect of the stern assures a good overall turning performance.

(c) The 3-point support ensures a good sea kindliness. At the same time, the skeg effect of the stern also improves the course stability in following seas.

(d) Because a plurality of rear planing portions are provided to the rear hull portion, a plurality of engines can be mounted.

(e) There is less limitation in arranging the cabin space, compared with the conventional 3-point-support type planing boat.

In this invention, it is desirable to provide a step to the rear end of the front planing portion to reduce the water contact area as much as possible and therefore the influence of waves.

It is also desired that front fins be provided to each side of the front hull portion to generate lift for floating the hull.

Further, by providing the lift generating fins to the rear hull portion as well as to each side of the front hull portion, it is possible to further reduce the depth of the draft when the boat is running at high speeds.

BEST MODE FOR CARRYING OUT THE INVENTION

Figure 1A:
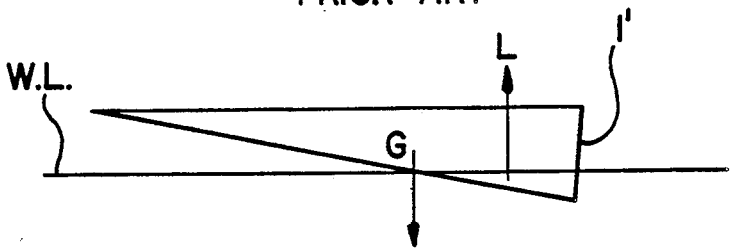
FIG. 1A PRIOR ART
FIGS. 1A and 1B are schematic views showing the characteristic of a single-hull type planing boat.
Figure 1B:
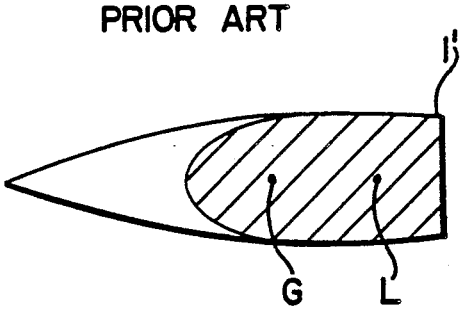
PRIOR ART FIG. 1B

In a single-hull type planing boat, as shown in FIGS. 1A and 1B, as the speed of the boat increases, the center of lift L of the single-hulled planing boat 1' generally shifts too much toward the afterpart of the hull with respect to the center of gravity G. This results in a porpoising and a large pitching, making the traveling unstable.

Figure 2A:
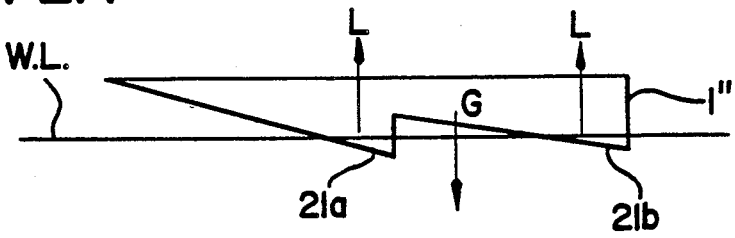
PRIOR ART FIG. 2A
FIGS. 2A and 2B are schematic views showing the characteristic of a conventional 3-point-support type planing boat with two support points at the forepart of the hull and one support point at the afterpart.
Figure 2B:
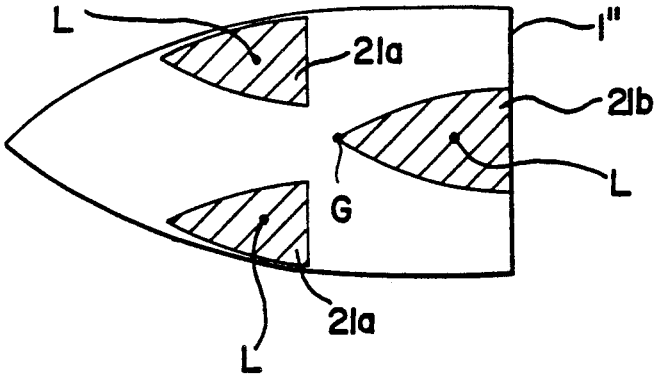
FIG. 2B PRIOR ART

On the other hand, as shown in FIGS. 2A and 2B, in a 3-point-support type planing boat 1'', which has its forepart supported by two planing portions **21*a* and its afterpart by one planing portion 21*b***, the center of gravity G is located between three front and rear lifts L even when the speed of the boat increases. This prevents porpoising and large pitching, realizing a stable planing on the surface of the water.

In the latter type, however, since the number of planing portions in the forepart of the hull is greater than that in the afterpart, the ability of making a turn is degraded. Another drawback is that since only one planing portion 21b is provided in the afterpart, it is difficult to mount two or more engines. Furthermore, there is a restriction in the arrangement of the cabin space.

A planing boat 1 of this invention has a special shape as shown in FIGS. 3 through 6. The planing boat 1 looks like a single-hull type at first sight but in reality it exhibits the contour of a so-called 3-point-support type with three support points-obe at the forepart and two at the afterpart-when it skims over the surface at high speeds, about 20 to 40 knots.

Figure 3:
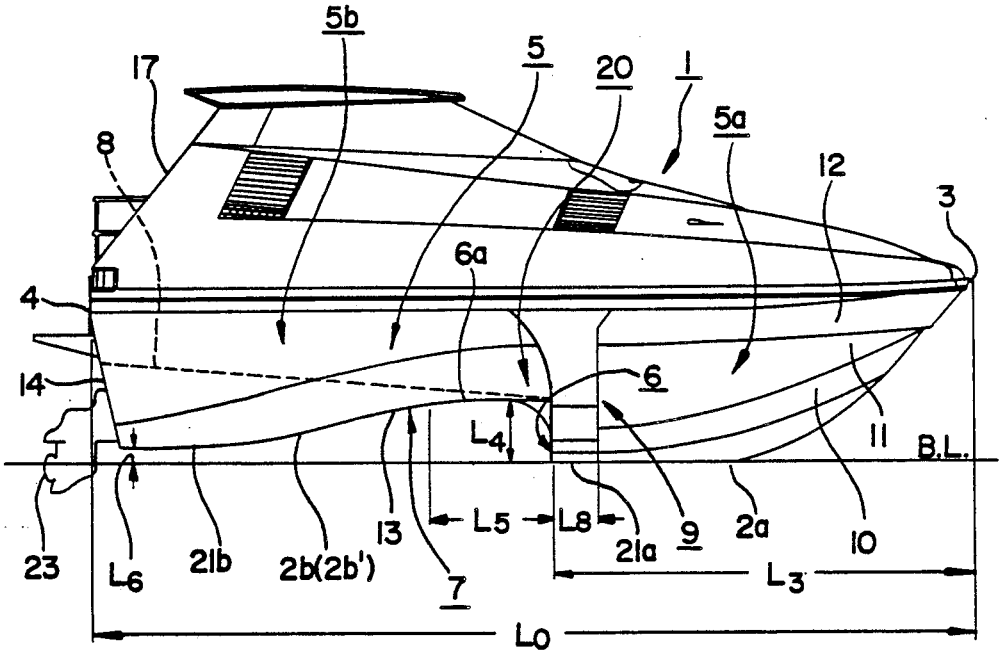
FIG. 3 is a side view of the planing boat as a first embodiment of the invention.

As shown in FIG. 3, a hull 5 of the planing boat 1 consists of a front hull portion 5a ranging from the bow 3 to the mid portion 20 and a rear hull portion 5b ranging from the mid portion 20 to the stern 4.

Figure 4:
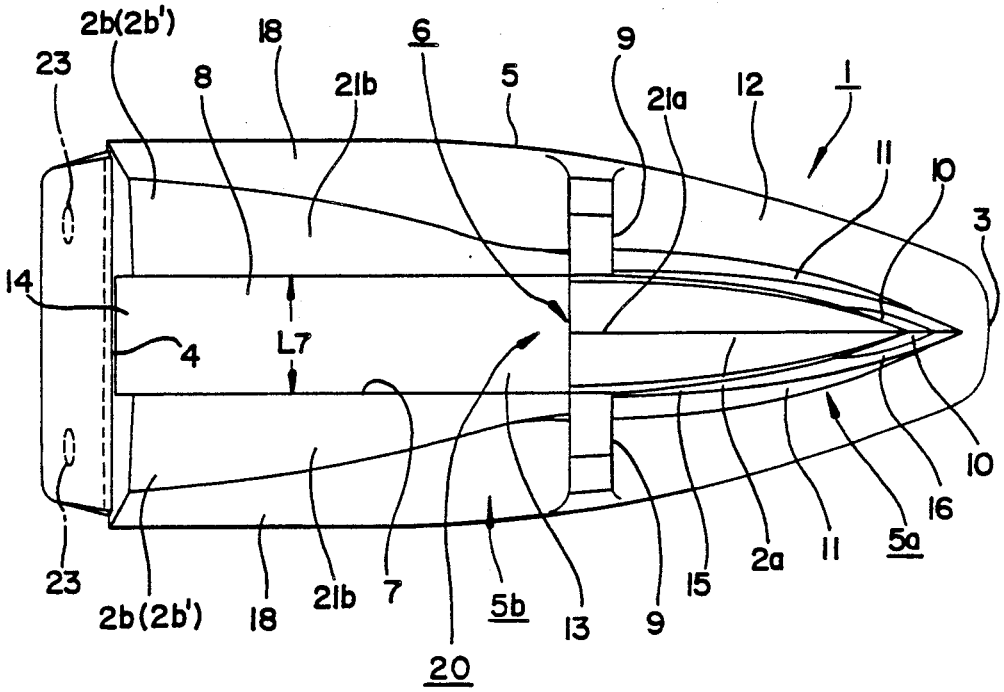
FIG. 4 is a bottom view of FIG. 3.

As shown in FIG. 4, a bottom part 2a of the front hull portion 5a forms a front planing portion 21a. A bottom part 2b of the rear hull portion 5b is formed with a recess 7. Two bottom parts 2b' on each side of the recess 7 form two rear planing portions 21b. The recess 7 has an opening 13 which opens downwardly from the bottom part 2b and an opening 14 which opens rearwardly from the stern 4.

If we let $L_0$ stand for the overall length of the planing boat 1, it is desirable to set the width $L_1$ and the height $L_2$ in the range of 0.25 $L_0$ to 0.50 $L_0$. The length $L_3$ of the front hull portion 5a is preferably set in the range of 0.30 $L_0$ to 0.70 $L_0$, or, more desirably, between 0.30 $L_0$ and 0.60 $L_0$.

The hull 5, as shown in FIG. 3, has a step 6 at the rear end of the front planing portion 21a to minimize the effects of waves. The step 6 is formed by providing the recess 7 to the bottom part 2b of the rear hull portion 5b. The height $L_4$ of the step 6 is preferably set in the range of 0.02 $L_0$ to 0.08 $L_0$.

The bottom parts 2b' of the rear hull portion 5b are provided with a hollowed-out portion 6a at the front end thereof. The length of the uppermost part of the hollowed-out portion 6a is preferably set in the range of 0.02 $L_0$ to 0.25 $L_0$. The rear ends of the bottom parts 2b' of the rear hull portion 5b are located $L_6$ above the base line B.L. The distance $L_6$ is desirably set in the range of 0 to 0.05 $L_0$.

The ceiling portion 8 of the recess 7, as shown in FIG. 3, is inclined upwardly rearwardly toward the stern 4. The width $L_7$ of the recess 7 is almost equal to that of the bottom part 2a of the front hull portion 5a. The width $L_7$ of the recess 7 is preferably set in the range of 0.06 $L_0$ to 0.15 $L_0$.

As shown in FIG. 4, a front fin 9 for generating a lift is provided to each side of the front hull portion 5a at the rear end.

Figure 5:
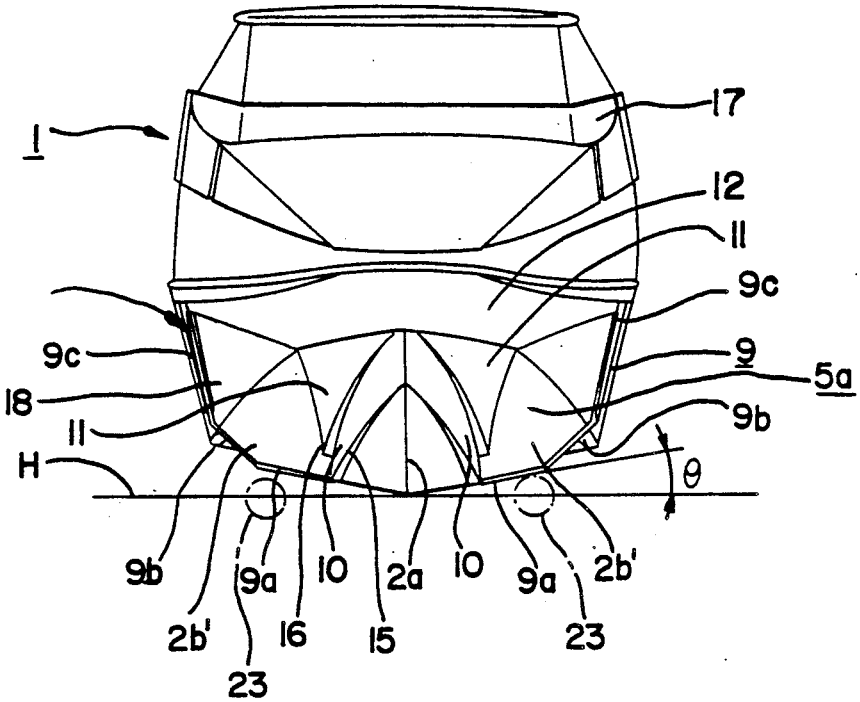
FIG. 5 is a front view of FIG. 3.
Figure 6:
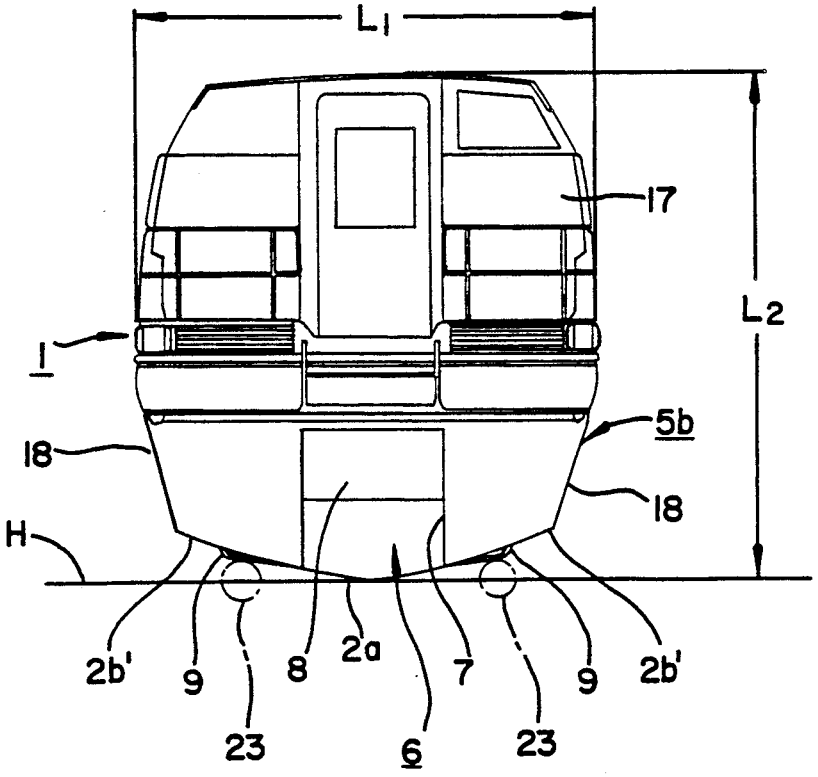
FIG. 6 is a back view of FIG. 3.

Each of the front fins 9, as shown in FIG. 5, consists of an inclined portion 9a fixed to the lower end of a first hull side 10 of the front hull portion 5a, a support portion 9c fixed to the upper end of a third hull side 12, and an intermediate portion 9b connecting these two portions 9a and 9c. The angle $\theta$ between the horizontal plane H and the inclined portion 9a of the fin 9 is preferably in the range between $-10°$ and 45°. The width $L_8$ of the front fin 9 is preferably in the range between 0.025 $L_0$ and 0.30 $L_0$.

The first hull side 10 and the second hull side 11 of the front hull portion 5a have almost no upward expansion, as shown in FIG. 5, to avoid undesirable influence of waves.

In the figure, reference numeral 15 denotes a first wave damper or moderator provided to the lower end of the first hull side 10; 16 a second wave moderator provided to the lower end of the second hull side 11; 17 a cabin; 18 a hull side of the rear hull portion 5b; and 23 a propeller, two propellers being mounted at the rear hull portion 5b.

Figure 7:
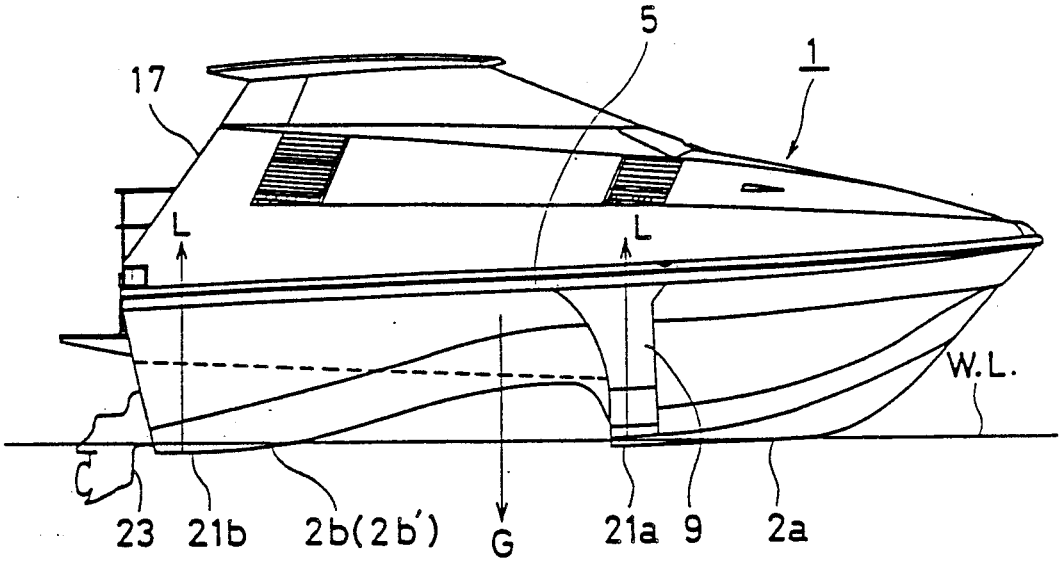
FIG. 7 is a perspective view showing the state of the planing boat while it is running at a high speed.

When the planing boat 1 of the above construction travels on the water surface at a low speed, the front planing portion 21a and the two rear planing portions 21b move forward fully submerged. As the speed increases, the floatage of the hull 5 increases and the lift by the front fins 9 also increases substantially, floating the hull 5. At a maximum speed, the boat travels with the hull 5 supported at three points, one front planing portion 21a and two rear planing portions 21b, as shown in FIG. 7. In the figure, G represents the center of gravity and L the lift.

Figure 8:
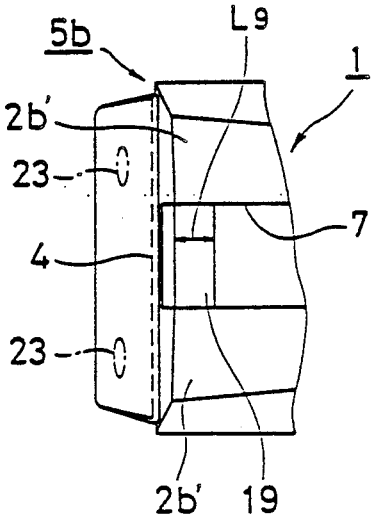
FIG. 8 is a bottom view showing the essential portion of the planing boat as a second embodiment of the invention.
Figure 9:
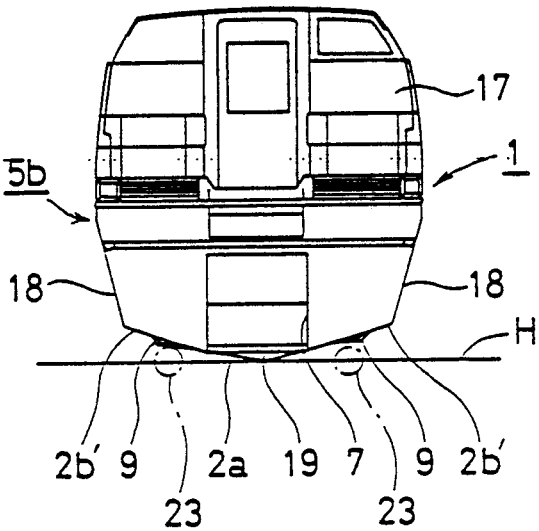
FIG. 9 is a back view of FIG. 8.

To make the draft of the stern shallow during running, a rear fin 19 may be mounted to the rear end of the rear hull portion 5b, straddling the recess 7, as shown in FIGS. 8 and 9. The width $L_9$ of the rear fin 19 is preferably be set in the range between 0.025 $L_0$ and 0.30 $L_0$.

Figure 10:
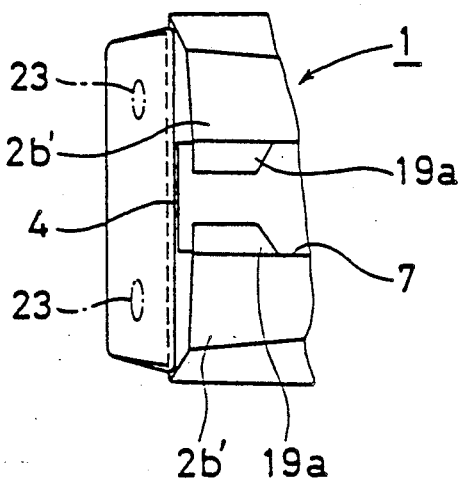
FIG. 10 is a bottom view showing essential portions of the planing boat as a third embodiment of the invention.
Figure 11:
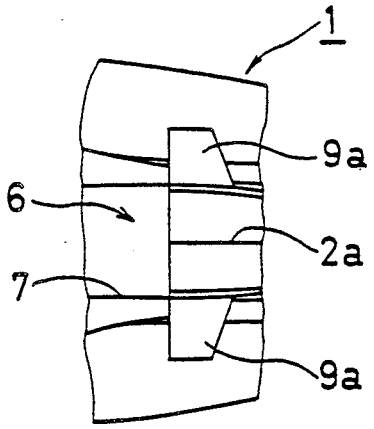
FIG. 11 is a bottom view showing essential portions of the planing boat as a fourth embodiment of the invention.
Figure 12:
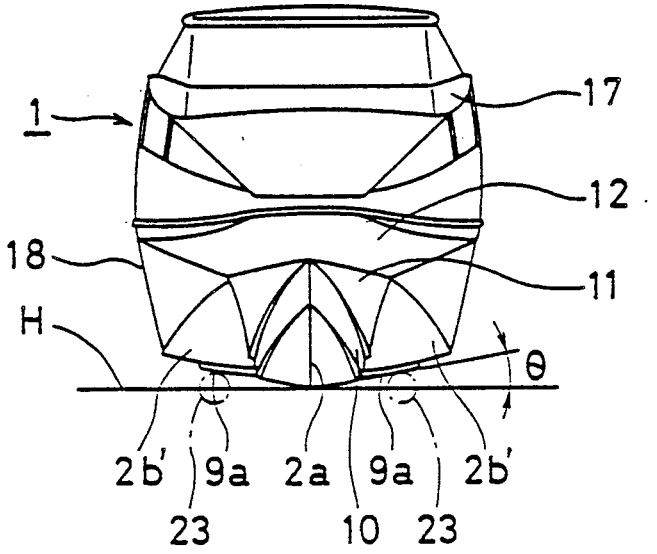
FIG. 12 is a front view of FIG. 11.

The rear fin 19 may be formed as a pair of cantilever fins 19a, 19a, as shown in FIG. 10. The front fin 9 may be formed of only the inclined portion 9a as shown in FIGS. 11 and 12.

Figure 13:
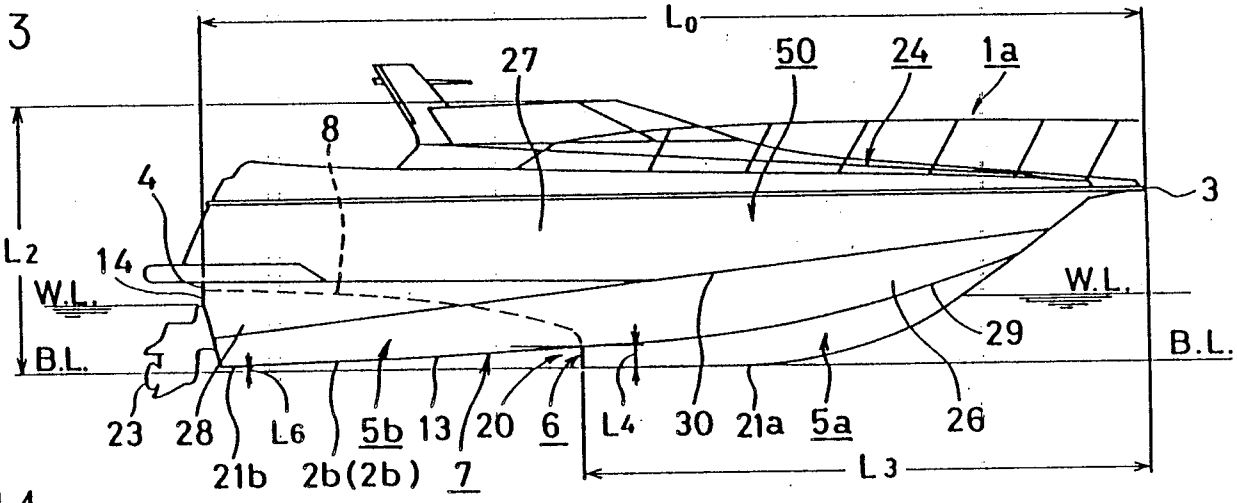
FIG. 13 is a side view of the planing boat as a fifth embodiment of the invention.
Figure 14:
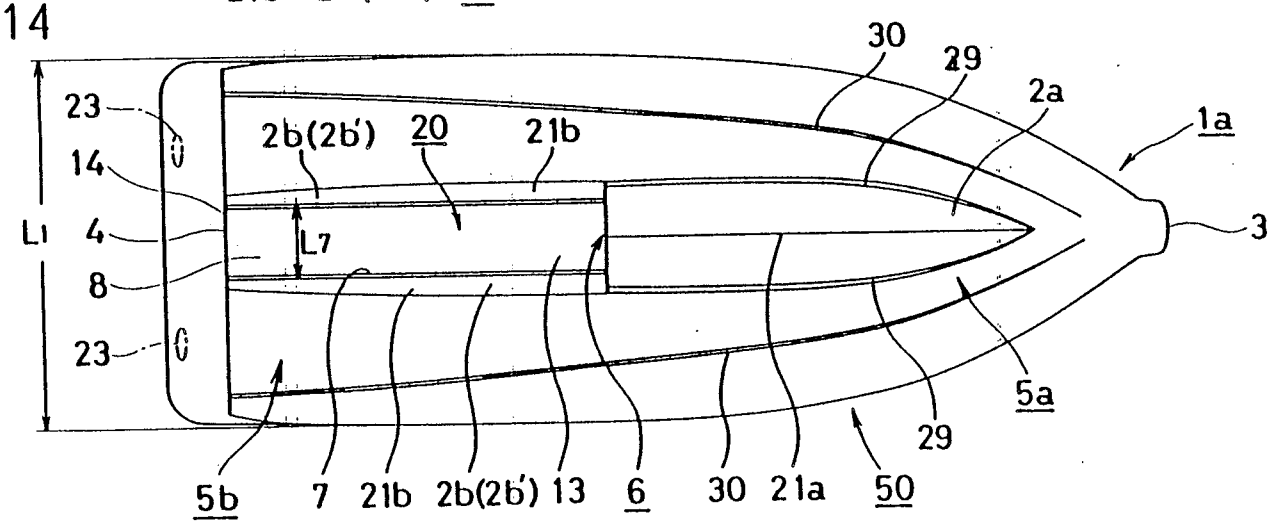
FIG. 14 is a bottom view of FIG. 13.
Figure 15:
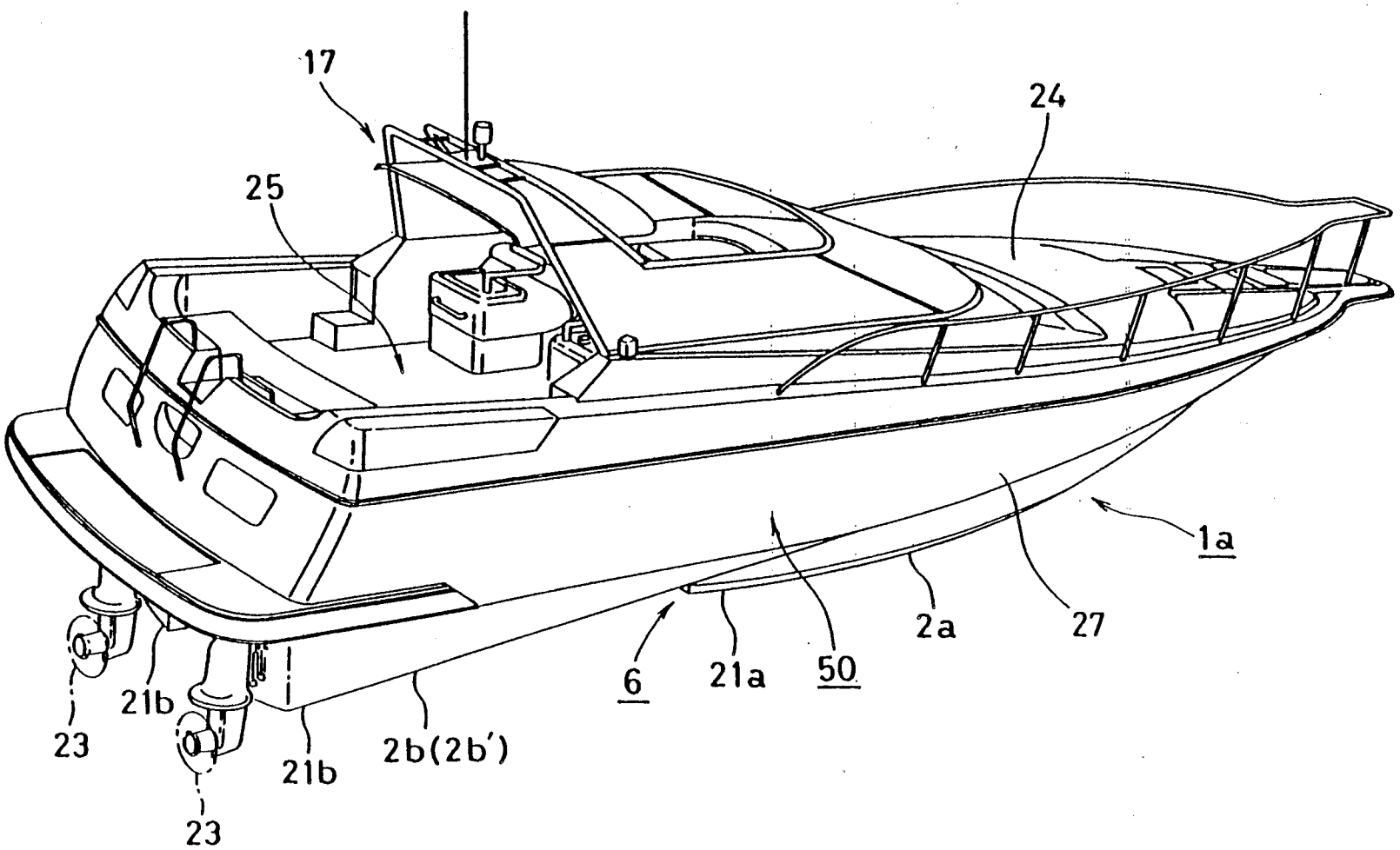
FIG. 15 is a perspective view of FIG. 13.

FIGS. 13 to 15 show a further embodiment of the planing boat according to this invention, whose construction is basically the same as that of the planing boat 1 of the first embodiment.

This embodiment differs from the first embodiment in that the width of the front hull portion 5a is not made excessively narrow and the boat's contour is made smooth and continuous over the entire length in order to provide as large a cabin space 25 as possible.

As shown in FIG. 13, the hull 50 of the planing boat 1a consists of a front hull portion 5a ranging from the bow 3 to the mid portion 20 of the hull and a rear hull portion 5b ranging from the mid portion 20 to the stern 4.

In FIG. 14, a bottom part 2a of the front hull portion 5a forms a front planing portion 21a. The rear hull portion 5b is formed at its bottom part 2b with a recess 7. Two bottom parts 2b' on each side of the recess 7 form two rear planing portions 21b. The recess 7 has an opening 13 which opens downwardly from the bottom part 2b and an opening 14 which opens rearwardly from the stern 4.

If we let $L_0$ stand for the overall length of the planing boat 1a, it is desirable to set the width $L_1$ and the height $L_2$ in the range of 0.25 $L_0$ to 0.50 $L_0$. The length $L_3$ of the front hull portion 5a is preferably set in the range of 0.30 $L_0$ to 0.70 $L_0$ or, more desirably, between 0.30 $L_0$ and 0.60 $L_0$.

The hull 50, as shown in FIG. 13, has a step 6 at the rear end of the front planing portion 21a to minimize the effects of waves. The step 6 is formed by providing the recess 7 to the bottom part 2b of the rear hull portion 5b. The height $L_4$ of the step 6 is preferably set in the range of 0.02 $L_0$ to 0.08 $L_0$.

The rear ends of the bottom parts 2b' of the rear hull portion 5b are located a distance $L_6$ above the base line B.L. The distance $L_6$ is desirably set in the range of 0 to 0.05 $L_0$.

The ceiling portion 8 of the recess 7, as shown in FIG. 13, is inclined upwardly rearwardly toward the stern 4. The width $L_7$ of the recess 7 is slightly narrower than the width of the bottom part 2*a* of the front hull portion 5*a*. The width $L_7$ of the recess 7 is preferably set in the range of 0.06 $L_0$ to 0.15 $L_0$.

A first hull side 26 and a second hull side 27 are formed smooth and continuous over the entire length from the bow 3 to the stern 4 so that a wide cabin space 25 can be provided under the deck 24.

Reference numeral 28 represents a third hull side provided between the first hull side 26 and the second hull side 27; 29 a first wave moderator provided to the lower end of the first hull side 26; 30 a second wave moderator provided to the lower end of the second hull side 27; 17 a cabin; and 23 a propeller, two propellers being mounted at the rear hull portion 5*b*.

In FIGS. 1A, 2A, 7 and 13, W.L. represents a static water surface.

We claim:

1. A planing boat comprising:

a front hull portion ranging from the bow to the mid portion of the hull, wherein said front hull portion has front fins on each side to generate lift, and wherein said front fins comprise inclined portions disposed at a lower end of said front hull portion, support portions disposed at an upper end of said front hull portion, and intermediate portions disposed between and connecting said inclined portions and said support portions;

a rear hull portion ranging from the mid portion of the hull to the stern, the rear hull portion being formed with a recess, the recess opening downwardly from the bottom part of the rear hull portion, the recess also opening rearwardly from the stern, the rear hull portion having a plurality of bottom parts on the left and right side of the recess, said recess comprising a ceiling portion inclined upwardly and rearwardly toward said stern;

a single front planing portion formed by the bottom part of the front hull portion substantially in the center thereof; and a plurality of rear planing portions formed by the plurality of bottom parts of the rear hull portion.

* * * * *